US006217190B1

(12) United States Patent
Altman et al.

(10) Patent No.: US 6,217,190 B1
(45) **Date of Patent: *Apr. 17, 2001**

(54) LIGHTING ASSEMBLY FOR MULTIPLE FLUORESCENT LAMPS

(75) Inventors: Barry Eddington Altman, Mechanicsburg, PA (US); John Francis Turner, Clemmons, NC (US); Kimberly Ann Ketelsleger, Mechanicsburg, PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/158,191

(22) Filed: Sep. 21, 1998

Related U.S. Application Data

(60) Provisional application No. 60/060,661, filed on Oct. 2, 1997.

(51) Int. Cl.[7] ..... F21K 27/00

(52) U.S. Cl. ..... 362/221; 362/222; 362/265; 362/217; 362/260

(58) Field of Search ..... 362/221, 222, 362/265, 217, 260

(56) References Cited

U.S. PATENT DOCUMENTS

| | | | | |
|---|---|---|---|---|
| 3,996,493 | * | 12/1976 | Davenport et al. | 315/58 |
| 4,857,928 | | 8/1989 | Gailus et al. . | |
| 5,003,232 | | 3/1991 | Venderbosch | 315/312 |
| 5,013,253 | | 5/1991 | Aiello et al. | 439/235 |
| 5,138,528 | * | 8/1992 | Altman | 362/400 |
| 5,140,324 | | 8/1992 | Przybysz et al. . | |
| 5,198,815 | | 3/1993 | Przybysz et al. . | |
| 5,327,130 | | 7/1994 | Kang et al. . | |
| 5,341,136 | | 8/1994 | Przybysz et al. . | |
| 5,345,406 | | 9/1994 | Williams . | |
| 5,349,508 | * | 9/1994 | Karbaf | 362/217 |
| 5,392,039 | | 2/1995 | Thurston . | |
| 5,720,546 | | 2/1998 | Correll, Jr. et al. | 362/221 |
| 5,907,218 | * | 5/1999 | Altman et al. | 315/56 |
| 6,079,851 | * | 6/2000 | Altman et al. | 362/260 |

OTHER PUBLICATIONS

Schreier, R., and Snelgrove, M., "Bandpass Sigma–Delta Modulation," *Electronic Letters*, vol. 25, No. 23 (Nov. 9, 1989): 1560–1561.

Raghavan et al.; "A Bandpass ΣΔ Modulator with92dB SNR and Center Frequency Continuously Programmable from 0 to 70MHz," *IEEE International Solid–State Circuits Conference*, (1997): 214–215.

Shoaei, Omid and Snelgrove, W. Martin, "Mulit–feedback Design for LC Bandpass Delta–Sigma Modulators," *IEEE International Symposium on Circuits and Systems* (ISCAS), vol. 1 (1995): 171–174.

* cited by examiner

*Primary Examiner*—Sandra O'Shea
*Assistant Examiner*—Anabel M. Ton

(57) ABSTRACT

A fluorescent lighting assembly (2) includes a ballast lampholder subassembly (4) located at one end of a troffer (80) and at least one lampholder connector (50) located at the opposite end. The ballast lampholder subassembly (4) includes ballast circuitry connected to fluorescent lamp terminals (17) all positioned within a ballast lampholder housing (6). A molded ballast lampholder cover (8) encloses three sides of the ballast lampholder subassembly and a stamped metal plate forms the ballast lampholder base (10), with the ballast circuitry located on a circuit board (27) positioned on the interior surface of the base. Integrally molded lampholders (15) extend from channels (14) on the cover (8) and are positioned between larger enclosure sections (12) which provide space for larger ballast components. Fluorescent lamp terminals (17) are inserted from the interior of the cover into cavities (16) in lampholders (15), and lead wires connect the terminals to the printed circuit board. Lampholder connectors (50) including integrally molded lampholders (51) are located at the opposite end of the fluorescent lighting assembly (2).

20 Claims, 9 Drawing Sheets

LIGHTING ASSEMBLY FOR MULTIPLE FLUORESCENT LAMPS

CROSS-REFERENCE TO RELATED APPLICATIONS

This application is being filed concurrently with U.S. patent application Ser. No. 09/158,195, now U.S. Pat. No 6,048,220, issued Apr. 11, 2000 both of which claim the benefit of U.S. Provisional Application No. 60/060,661, filed Oct. 2, 1997, and have the same assignee.

BACKGROUND OF THE INVENTION

1. Field of the Invention

This invention is related to lighting assemblies and is more particularly related to fluorescent lighting assemblies using electronic ballasts. More particularly, this invention is related to a fluorescent subassembly or lampholder including ballast components and integral fluorescent sockets.

2. Description of the Prior Art

Conventional ballasts used in overhead troffers or luminaires include lamps, ballasts and socket subassemblies or lampholders. The ballast or ballasts are mounted at the center of the troffer and attached to the top of the troffer. Wires extend from the ballast or ballasts to sockets located at opposite ends of the troffer. For a four lamp assembly, wires must be connected to sockets at both ends of the four lamps. When a defective ballast is replaced, often on a trial and error basis, these wires must be disconnected and reconnected. Installation and maintenance of conventional lighting assemblies is therefor time consuming and the manufacturing cost of the lighting assembly is increased.

One approach to simplifying and therefore reducing the cost of ballast installation is disclosed in U.S. Pat. No. 5,720,546 assigned to The Whitaker Corporation. This patent discloses an integral ballast that can be mounted at one end of a lighting assembly. A neutral wire is connected to the opposite end of the lighting assembly and this wiring must be completed during assembly of the lighting fixture. U.S. patent application Ser. No. 08/967,534 discloses a lighting assembly in which a ballast subassembly, including a ballast circuit similar to the MULTILITE MUL120 ballast circuit, can be mounted on a single end of a troffer with commoning contacts located at the opposite end. The ballast components are mounted on a printed circuit board positioned in a metal housing with conventional fluorescent sockets mounted on the exterior of the housing and connected to the printed circuit board.

U.S. Pat. No. 5,013,253 discloses another approach to simplifying the construction of fluorescent lighting fixtures. This patent discloses a method of wiring an otherwise conventional fluorescent lampholder in which wire leads are positioned in an insulating housing to connect terminals in integrally molded lamp sockets with an external connector block. Conventional external ballasts can then be wired to lamp sockets using this external connector block.

SUMMARY OF THE INVENTION

The principal objective of the instant invention is to simplify the assembly of fluorescent ballasts and of fluorescent lighting assemblies. By simplifying the manufacture of these assemblies they can be made more cost effective. The instant invention achieves these manufacturing improvements not only by changes to the assembly procedure, but by changes to the components themselves, which permit changes to the manufacturing procedure.

According to the invention, a fluorescent lighting assembly includes a ballast lampholder subassembly and at least one lampholder connector. The ballast lampholder and the at least one lampholder connector are located at respective opposite ends of the fluorescent lighting assembly with fluorescent lamps or tubes extending between. In a preferred embodiment, the ballast lampholder subassembly and the lampholder connector are mounted on a fluorescent lighting troffer. Each of the housings for both the ballast lampholder subassembly and the lampholder connector include a molded housing part. In a preferred embodiment, a plurality of lampholders comprise integrally molded extensions of this molded housing part, such as the cover for the ballast lampholder subassemblies. The lampholders include terminal cavities into which fluorescent lamp terminals can be inserted. Wires are crimped to these terminals before insertion into the terminal cavities, and these wires are then used either to attach the terminals to the ballast circuitry on the interior of the housing or to other terminals.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
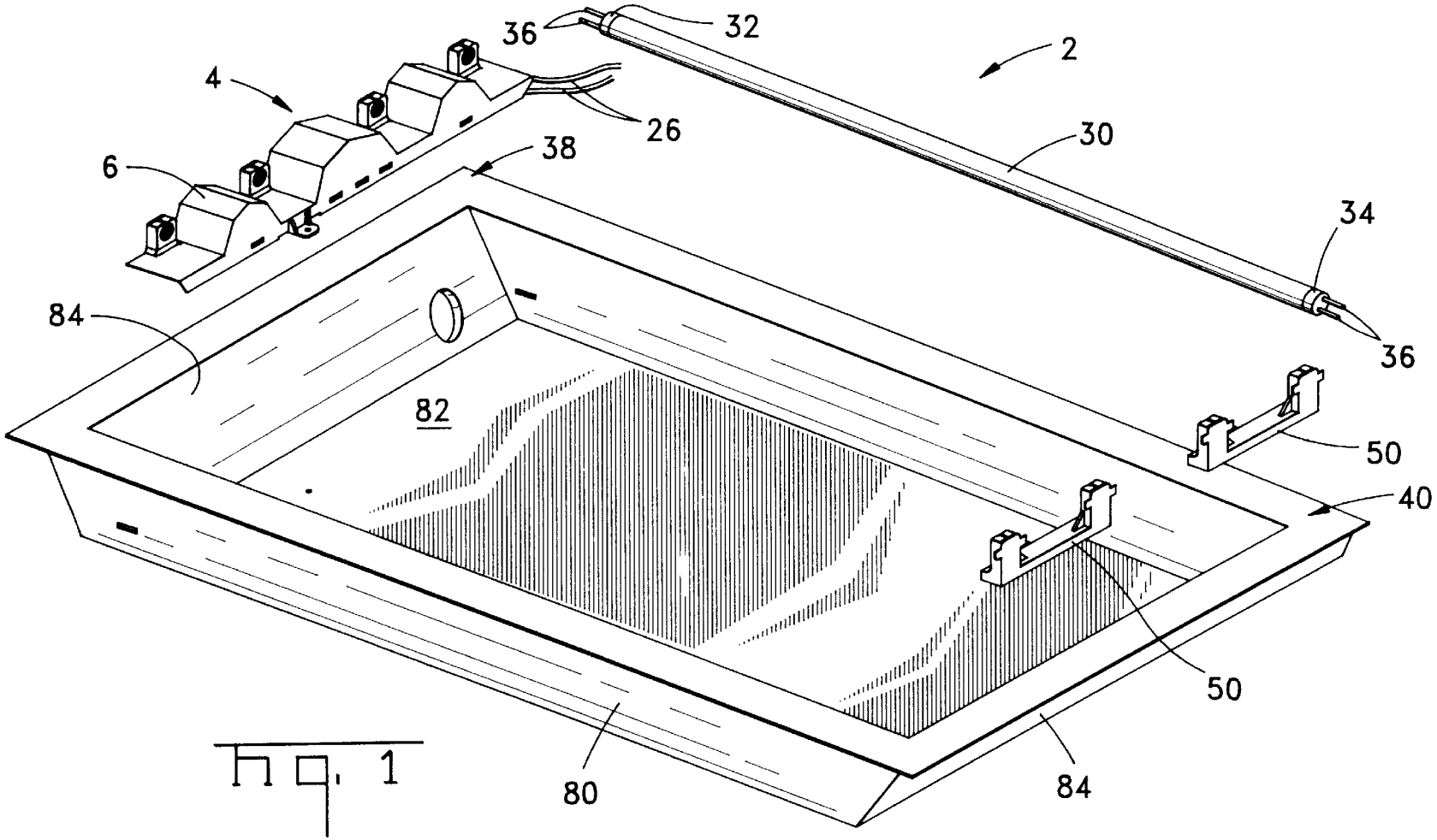
FIG. 1 is an exploded view showing the basic components of a fluorescent lighting assembly that can be used with fluorescent lights in a fluorescent ceiling unit.

The fluorescent lighting assembly 2 as shown in FIG. 1 is intended to mount four conventional fluorescent lamps in a ceiling. This lighting assembly includes a ballast lampholder subassembly 4 located on a first end 38 of the lighting assembly, fluorescent lamps 30 extending between the first end 38 and the second end 40 of the lighting assembly 2, lampholder connectors 50 located at the second end 40 and a troffer 80 in which the other components are mounted. The preferred embodiment of this lighting assembly is of the type that could be mounted in a suspended ceiling in an office building. The lighting assembly 2 and the troffer 80 are shown in an inverted position in FIG. 1 so that the surface of the troffer, facing downward when installed, is visible. This lighting assembly 2 can employ conventional fluorescent lamps 30. In the preferred embodiment the lighting assembly 2 and the ballast lampholder subassembly 4 are of the type that would be used with instant start T-8 fluorescent lamps. The ballast subassembly 4 is an electronic ballast of the type that can energize two eight foot fluorescent lamps or four lamps that are each four feet in length as in this embodiment.

Figure 2:
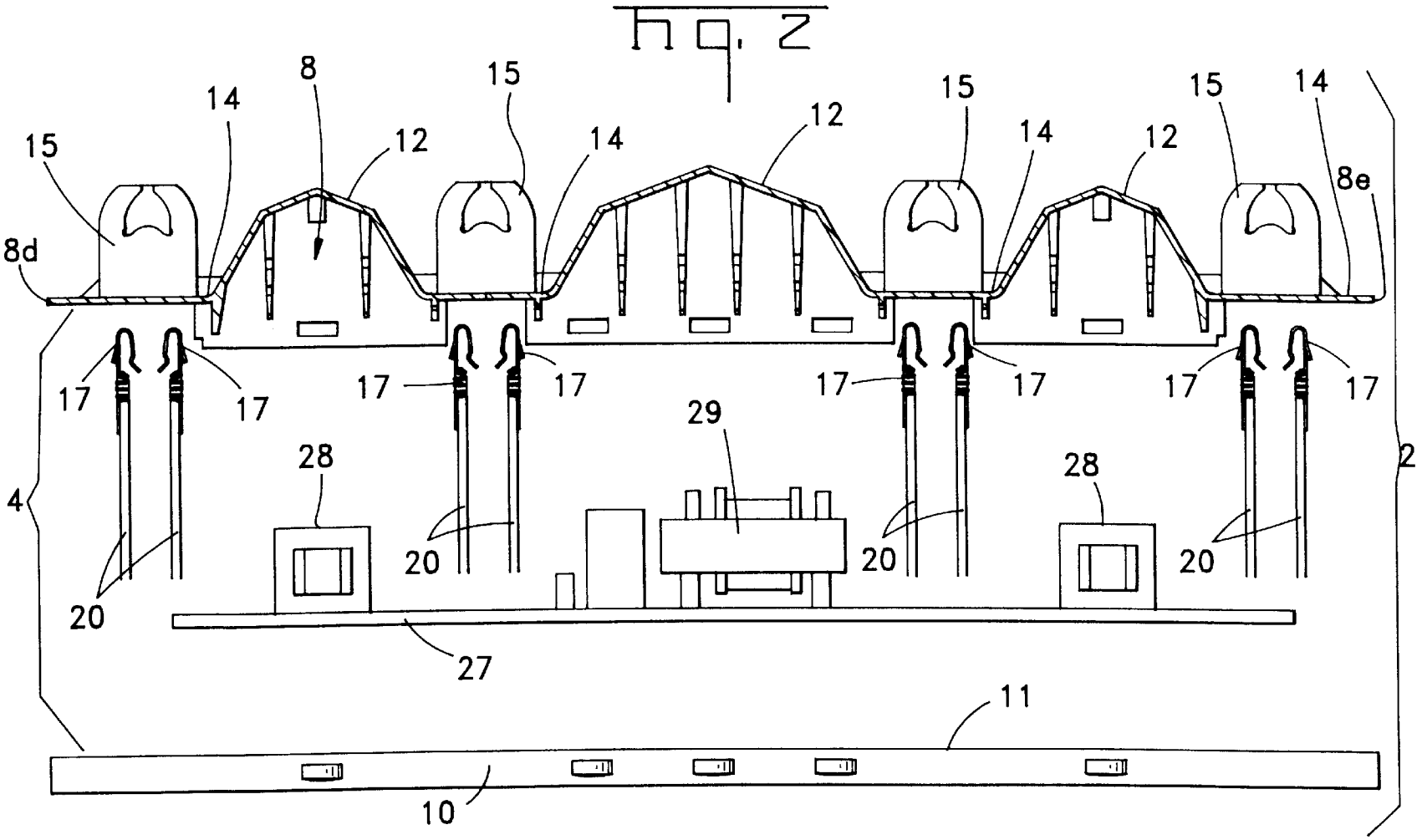
FIG. 2 is an exploded view showing the components of a ballast lampholder subassembly.

The components of the ballast lampholder subassembly 4 are shown in the exploded view of FIG. 2. Ballast lampholder subassembly 4 is an integral unit or hub comprising a ballast housing 6 (FIG. 1) that includes a housing cover 8 attached to a housing base 10 that encloses the electronic ballast circuitry and components on the interior of the housing 6. The housing cover 8 is molded from a thermoplastic and the housing base 10 can be fabricated from sheet metal or plastic. In the preferred embodiment, the housing base 10 is a stamped metal plate that serves as a grounding member when connected to the metal troffer 80 (FIG. 1).

Figure 3:
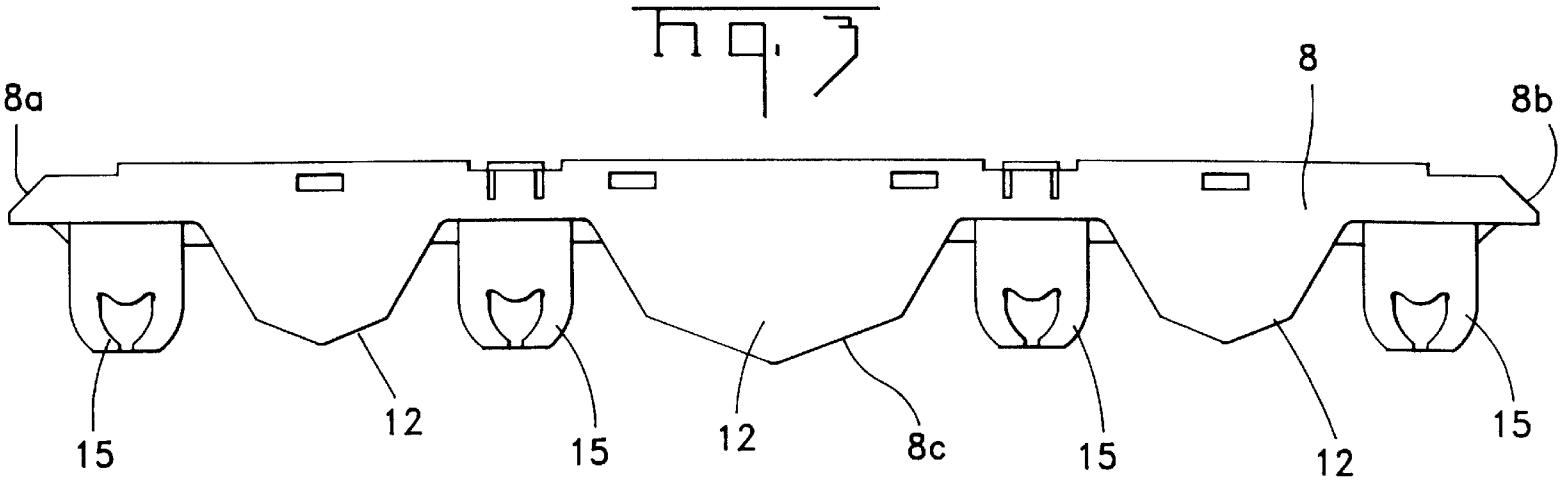
FIG. 3 is a side view of the housing of the ballast lampholder subassembly.
Figure 4:
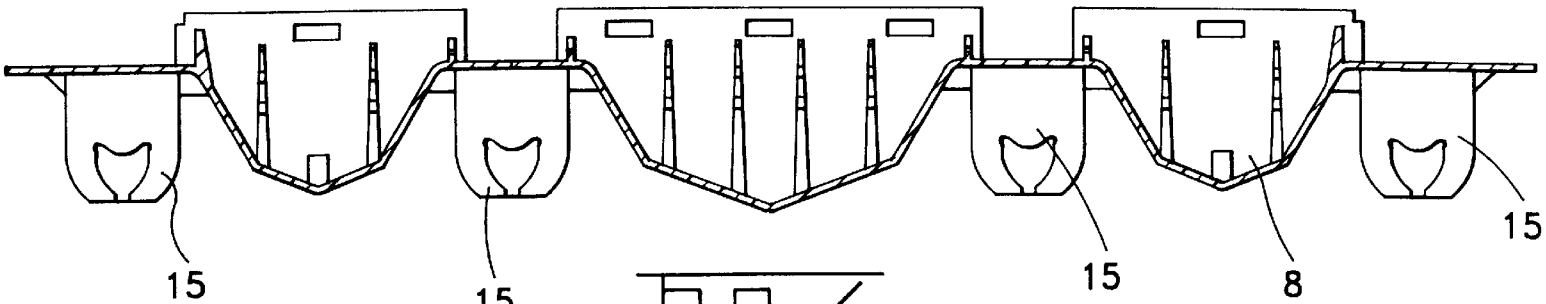
FIG. 4 is a section view of the housing shown in FIG. 3.

The housing cover 8 is attached to the housing base 10 to form the housing 6 enclosing the fluorescent ballast. With reference also to FIG. 3, the housing cover 8 has opposite sides 8*a*, 8*b* and top 8*c* which enclose three sides of the housing 6. The cover 8 extends between ends 8*d* and 8*e* (FIG. 2) that would be adjacent to the opposite interior surfaces of a lighting assembly 2. The housing base 10 encloses the fourth side of the housing 6.

As shown in FIGS. 2 and 3, ballast lampholder housing cover 8 includes three protruding housing areas 12 that provide room for the larger components in the power supply circuit and the ballast circuit of the electronic ballast. Four channels 14 are located on the top of the ballast subassembly 4 and extend between and on either side of the protruding housing areas or enclosures 12. Channels 14 provide space for mounting fluorescent lamps 30 in fluorescent lampholders 15 that have a conventional mounting configuration. A fluorescent lamp lampholder 15 is located in each channel 14 to engage pins on the first base of a fluorescent lamp 30. These lampholders 15 are integrally molded as part of the housing cover 8.

Figure 5:
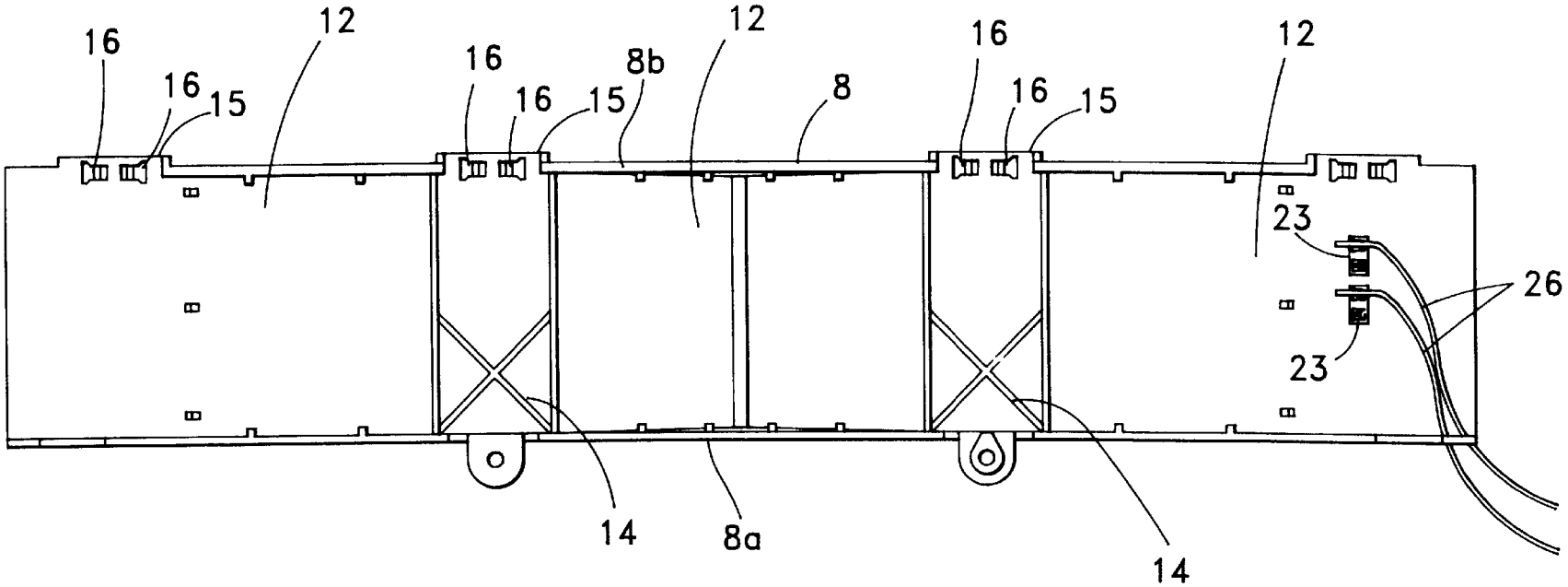
FIG. 5 is a bottom view showing the interior of the housing shown in FIG. 3.
Figure 6:
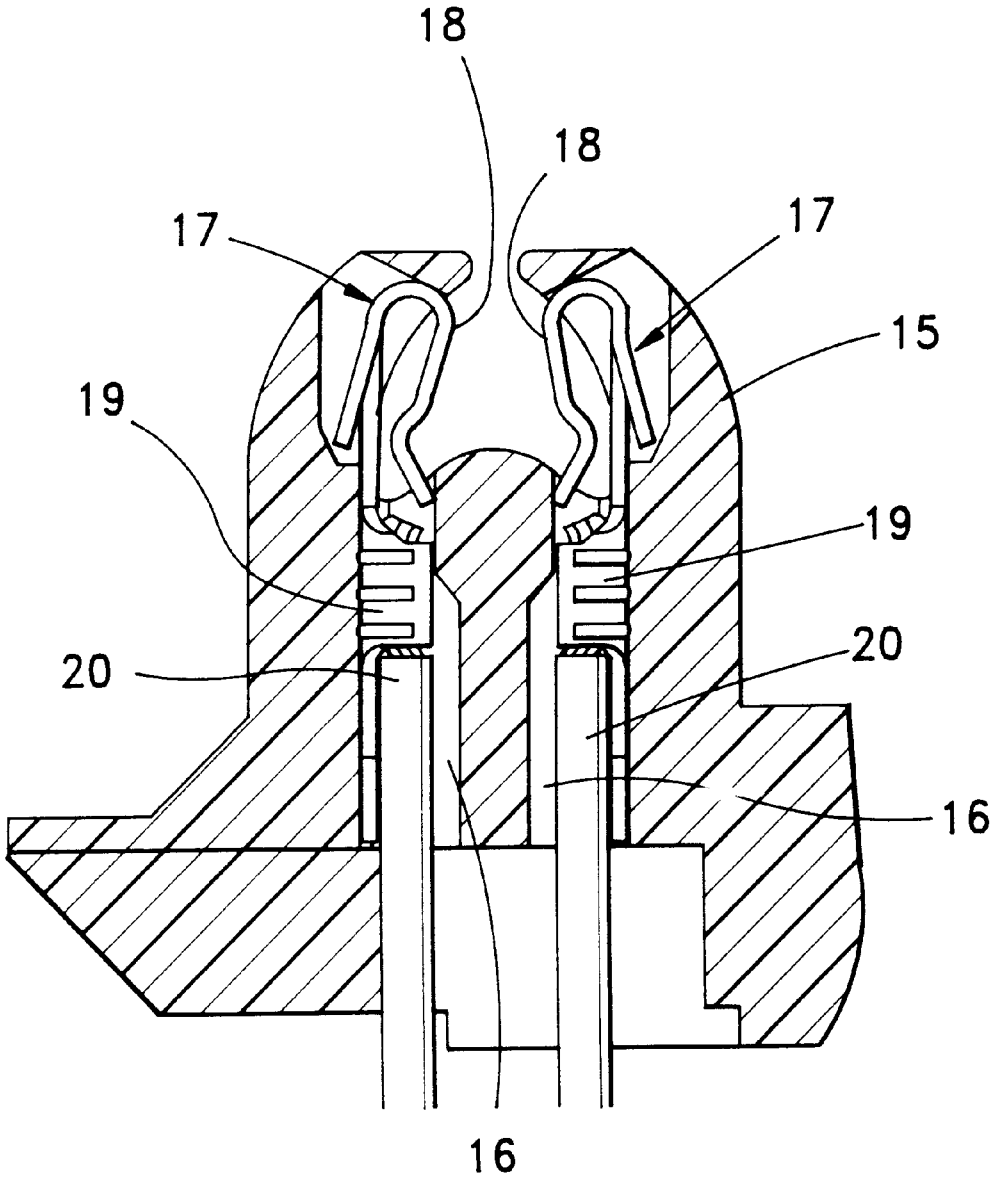
FIG. 6 is a view showing an individual lampholder of the type which can be used on the ballast lampholder subassembly or on the lampholder connector subassembly.

With reference also to FIGS. 5 and 6, each of the lampholders 15 has a pair of terminal cavities 16 in which fluorescent lamp terminals 17 are positioned. The lampholders 15 have a conventional lamp mounting configuration and are intended to receive one end of a bi-pin fluorescent lamp 30. The terminal cavities 16 open onto an interior surface of the housing cover 8 so that the terminals can be inserted into the integrally molded lampholders 15. The fluorescent lamp terminals 17 each include a terminal spring 18 and a crimp barrel 19 that attaches the terminal 17 to the stripped end of an insulated lead wire 20. Terminal springs 18 of opposed terminals 17 face the center of the lampholder 15 and are deflected outwardly when a bi-pin lamp 30 is rolled into the lampholder 15. In the preferred embodiment terminals 17 comprise stamped and formed terminals manufactured by AMP Incorporated as Part Number 640483.

As shown in FIG. 5, the housing cover 8 also includes splicing terminal mounting pockets 23 molded on the interior of the cover 8. A conventional insulation displacing splicing terminal can be inserted into each pocket 23 to splice wires spanning the pocket 23. External power lead wires 26 can be spliced to wires extending from a printed circuit board 27, shown in FIG. 2, containing ballast circuitry and ballast components. The wires 26 are suitable for supplying external electrical power to the ballast subassembly. The splicing terminal in each pocket 23 comprises a conventional terminal manufactured by AMP Incorporated as part number 62833-1 and the pocket 23 is configured to receive this terminal. The splicing terminal includes parallel insulation displacement slots each having parallel beams which engage the wires 26 to not only establish an electrical connection, but also to establish a redundant termination to the wire to provide an effective mechanical strain relief without additional components. Other leads (not shown) can be attached to a poke-in section of each splicing terminal and these leads are attached to other components in the ballast subassembly. In addition to other components of an electronic ballast, the printed circuit board 27 includes larger components such as output inductors 28 and a choke 29 as shown in FIG. 2. These larger components are positioned on the printed circuit board 27 so that they can be mounted in the larger enclosure sections 12 between the lampholders 15. As shown in FIG. 1, the ballast lampholder subassembly 4 is mounted on only one end of the lighting assembly 2 and the troffer 80.

Fluorescent lamps 30 are conventional tubular fluorescent lamps with a first bi-pin base 32 at one end and a second bi-pin base 34 at the opposite end. Two pins 36 at each end are conventional. Fluorescent lamps 30 are instant start lamps with a conventional instant start electrode (not shown) connected to the pins 36 at the ends of the glass envelope forming the lamp 30. In the preferred embodiment the fluorescent lamps 30 are used with a suitable instant start electronic ballast circuit and power supply circuit such as that used in the MULTILITE MUL120 manufactured and sold by Electrofab, Ltd. The components of this ballast circuitry are included on printed circuit board 27. The pins 36 fit within the lampholders 15 which are part of the ballast subassembly 4. The lamps 30 can be rolled into position in the lampholders in a conventional manner. Since the preferred embodiment of this invention employs instant start fluorescent lamps, it should be understood that instant start fluorescent lamps having a single pin on each base could also be employed with suitable lampholdrs. This invention could also be employed with preheat fluorescent lamps and a suitable preheat electronic ballast.

In this invention, only the first base 32 of each fluorescent lamp 30 is connected directly to the electronic ballast in ballast lampholder subassembly 4. The opposite second base 34 and the pins 36 therein are connected to lampholders in a lampholder connector 50. The preferred embodiment of this invention is intended to be used with multiple fluorescent lamps 30, and in the four lamp version of this invention, the fluorescent lamps are paired so that for each pair of fluorescent lamps, the respective first base 32 is attached to the ballast and the respective second bases 34 of the two lamps in each pair are electrically commoned in the lampholder connector 50. In the preferred embodiment of FIGS. 1–8, the pins 36 in the second base 34 of one lamp in each pair of lamps are connected to the corresponding pins 36 in the other lamp of that pair of lamps. For this invention, only the first bases 32 at the first end 38 of the lighting assembly will be energized to start the lamps. No current will flow through the pins 36 in the second bases 34 of the fluorescent lamp pairs until an arc is established between the opposite ends of each lamp 30. By using an electronic ballast, such as the MULTILITE MUL120 manufactured and sold by Electrofab, Ltd., that is capable of operating fluorescent lamps of twice the length of the lamps 30, it then becomes possible to common the second bases 34 through one of the lampholder connectors 50. The electronic ballast used in ballast subassembly 4 is also capable of operating two separate pairs of fluorescent lamps, so the preferred embodiment employs two pairs or four lamps 30.

Figure 9:
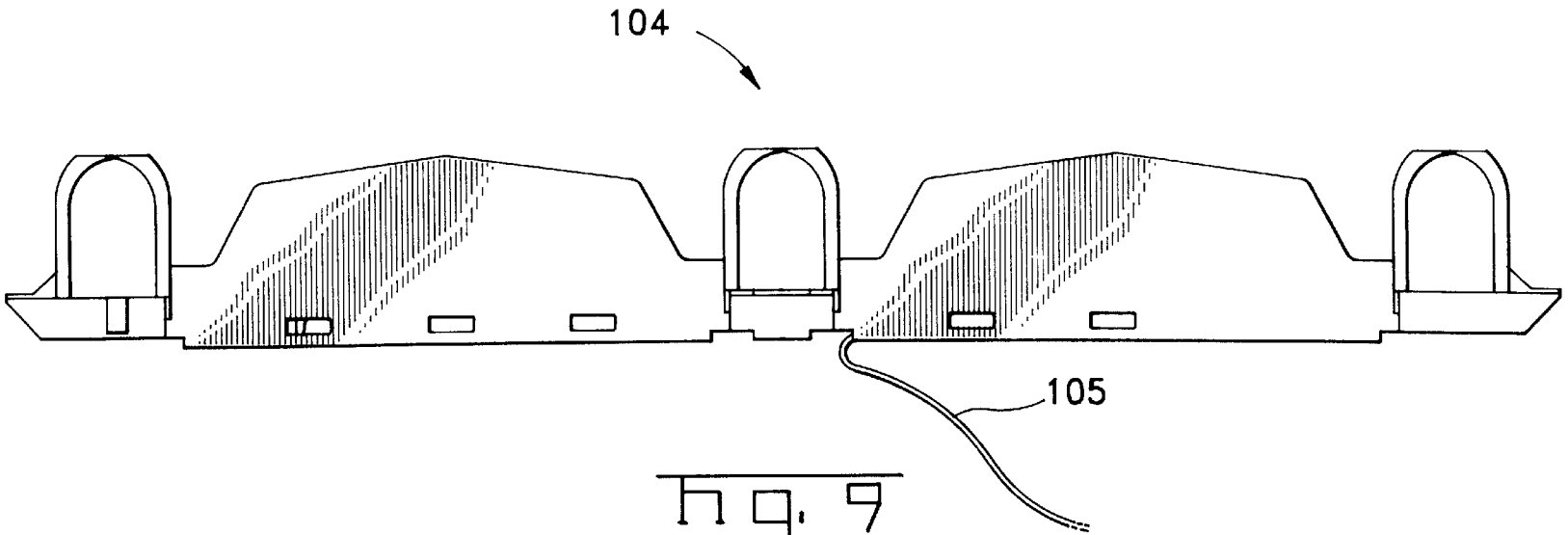
FIG. 9 is a view of a three lamp ballast lampholder subassembly used in another embodiment of the invention.
Figure 10:
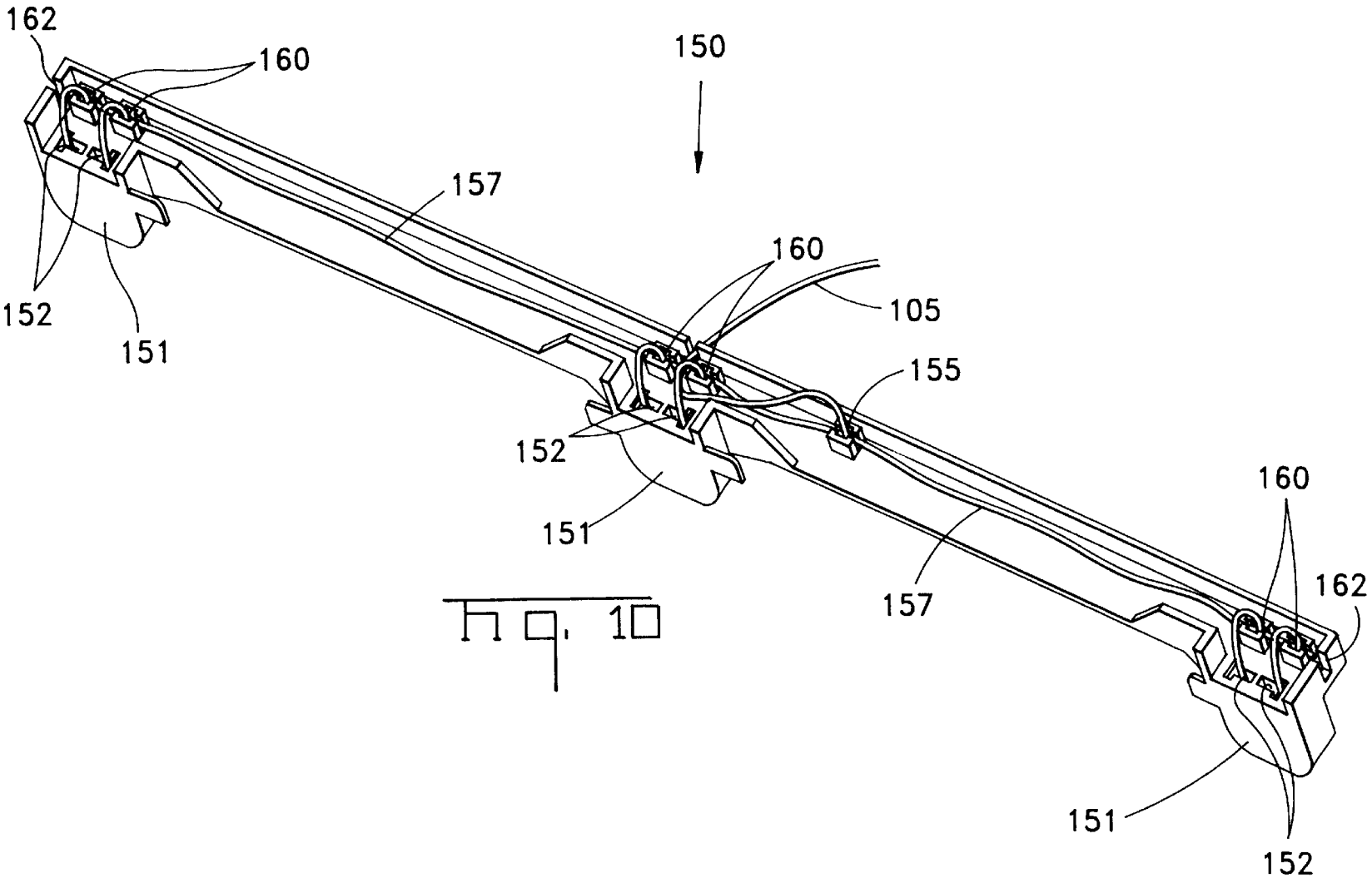
FIG. 10 is a view of a three lamp lampholder connector used with the ballast lampholder subassembly shown in FIG. 9 to form a three lamp fluorescent lighting assembly.

With reference to FIGS. 9 and 10, ballast lampholder subassembly 104 and lampholder connector 150 are three lamp versions of the lampholder subassembly 4 and lampholder connector 50, respectively. The ballast lampholder subassemblies 4, 104 and the lampholder connectors 50, 150 are fabricated and assembled so that the cost of the fluorescent lighting subassembly can be significantly reduced. By molding the lampholder cover 8 and the corresponding cover for the three lamp version 104 with integrally molded lampholders 15, the cover can be used to simplify assembly. This is best appreciated by referring to FIG. 2. The fluorescent lamp terminals 17 can be crimped to wires 20 and inserted into the lampholders 15 with the wires extending downward from the cover 8. Opposite ends of these wires 20 can then be attached to the printed circuit board 27 either by soldering or by inserting terminals crimped to the wire ends onto pins soldered to the printed circuit board. For example, a receptacle, such as AMP Incorporated part number 61291, can be crimped to the end of each wire 20, and it can be mated to a pin, such as AMP Incorporated part number 61137, previously soldered to the printed circuit board 27. This approach simplifies hand wiring of the fluorescent lamp terminals to the ballast circuitry on the printed circuit board. Next, the printed circuit board can be positioned on the interior surface of the housing base 10. If the housing base 10 comprises a stamped metal plate, the ballast circuit can be grounded to this base, which can in turn be attached by screws or other fasteners to the metal troffer 80 (FIG. 1) when the ballast lampholder subassembly 4 is placed in service. Power wires 26 are attached to the ballast circuitry by using a splicing terminal in a pocket 23 in the manner which was discussed previously with reference to FIG. 5. After the internal components have been assembled in this manner, the housing base 10 can be snapped to the housing cover 8 to complete the assembly of the ballast lampholder subassembly 4.

The integral ballast lampholder subassembly 4 and the lampholder 50 can be mounted on troffer 80 as shown in FIG. 1. Troffer 80 is generally conventional in construction having a top wall 82, two end walls 84 at the first and second ends of the lighting assembly and two side walls. Since the ballast lampholder subassembly 4 is mounted at an end of the troffer 80, the four fluorescent lamps 30 can be mounted in the troffer on substantially equally spaced centerlines without the need for additional space between the two center fluorescent lamps to accommodate a conventional ballast.

Figure 7:
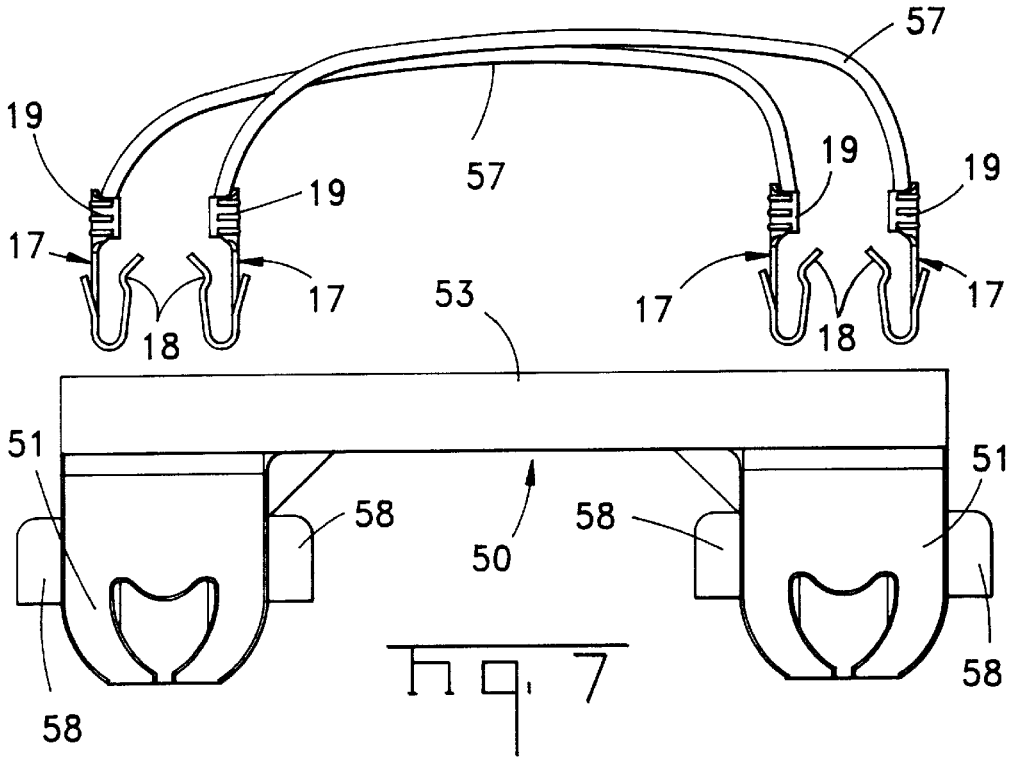
FIG. 7 is a view of the components of a lampholder connector subassembly.
Figure 8:
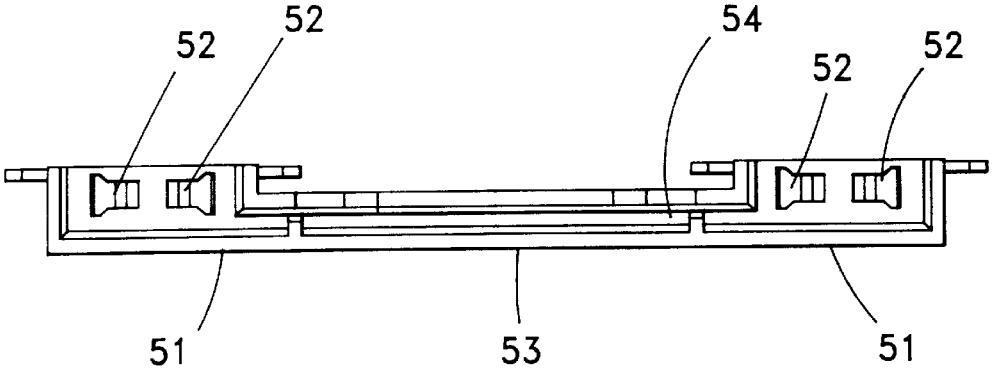
FIG. 8 is a bottom view of a lampholder connector subassembly.

With reference to FIGS. 1, 7 and 8, the lampholder connector subassemblies 50 which are located at the opposite end of the troffer 80 include a molded housing with connector lampholders 51 molded to the housing in much the same manner as for the ballast lampholder subassembly 4. Fluorescent lamp terminals 17 as previously described are inserted into the lampholders 51. However, the terminals in the lampholder connector subassembly need not be connected to the ballast. These fluorescent lamp terminals 17 merely connect corresponding pins of multiple fluorescent lamps 30. Therefore these fluorescent lamp terminals 17 can be joined by wires 57 extending between two terminals in different connector lampholders 51. Each wire 57 joins two corresponding terminals 17 in two lampholders 51. In the embodiment shown, two connector lampholders 51 are located at opposite ends of a connector base 53. Terminal cavities 52 in each connector lampholder 51 open onto an open lower surface or trough 54 of the connector housing. The wire leads 57 extending between two spaced-apart lampholders 51 are disposed in this trough 54 on the underside of the lampholder base 53. The wire leads 57 are held in the trough 54 by molded-in raised nubs that keep the wire leads tucked into the troughs 54 for wire management and to prevent the wire leads 57 from dangling out of the troughs 54. The same basic approach shown for the two-lamp lampholder connector 50 can be used for a four-lamp lampholder. For both the two-lamp and four-lamp versions the same terminal subassembly comprising two fluorescent lamp terminals 17 connected by a wire lead 57 could be used, because the length of the wire lead 57 would be the same.

Lampholder connectors 50 also include mounting tabs 58 extending from opposite sides of the lampholders 51. These tabs 58 can be inserted into slots (not shown) on the end walls 84 of the troffer 80 to mount the lampholder connectors 50 with connector lampholders 51 in alignment with the lampholders 15 on the ballast lampholder subassembly 4 at the opposite end of the lighting fixture assembly 2. The two dual position lampholder connectors 50 shown in FIGS. 1 and 7 do not need to be connected to the ballast circuitry in the ballast lampholder subassembly 4 because the electronic ballast circuit used in this embodiment can be used to initiate and power two four foot lamps 30. One of the dual lampholder connectors 50 connects the opposite ends of two side-by-side fluorescent lamps 30.

A second embodiment of this invention is shown in FIGS. 9 and 10. This embodiment uses a three-lamp ballast lampholder subassembly 104 and a three-lamp lampholder connector 150. The three-lamp ballast lampholder subassembly 104 includes a ballast circuit for use in a three-lamp lighting fixture, but in most other respects is constructed in the same manner as the four-lamp version. The principal difference is that the three-lamp ballast lampholder subassembly 104 includes a wire 105 that connects the three-lamp ballast lampholder subassembly 104 to the three-lamp lampholder connector 150 located at the opposite end of the fluorescent lamps in a three-lamp lighting fixture. This wire 105 is connected to the ballast lampholder subassembly 104 in substantially the same manner as to the lampholder connector 150, and attachment of this wire will be discussed with reference to the lampholder connector 150. The three-lamp lighting fixture thus can operate in much the same manner as that described in U.S. Pat. No. 5,720,546 which is incorporated herein by reference.

As shown in FIG. 10, lampholder connector 150 includes three lampholders 151 with two terminal cavities 152 in each lampholder 151. The same terminals 17 are used in this three-lamp lampholder connector 150. The lampholder connector 150 also includes two pockets 160 located adjacent to the terminal cavities 152 in each lampholder. In addition to the six pockets 160, a seventh pocket 155 is located adjacent to the central lampholder. Each of these molded pockets is configured to receive a splicing terminal 56, shown in FIG. 11, which in a preferred embodiment comprises a conventional terminal manufactured by AMP Incorporated as part number 62833-1. As shown in FIG. 10, a single bus wire 157 extends between opposite ends of the three-lamp lampholder 150, and this single bus wire 157 extends through all of the pockets 155 and 160. Each pocket includes slots on either side so that the bus wire 157 can be laced through the slots so as to span the corresponding pockets 155 and 160. After the bus wire 157 has been inserted into each of the pockets, a splicing terminal 56 is inserted into each pocket. Each splicing terminal 56 includes two insulation displacement slots defined by opposed metal edges which engage the bus wire 157 to form a gas tight permanent electrical connection to the bus wire 157 in a conventional manner. In addition to the insulation displacement slots, each splicing terminal 56 also includes a poke-in terminal portion which can engage the stripped end of a wire when the stripped end is inserted into the poke-in terminal portion. Alternatively, a spade terminal may be attached to the stripped end of the wire and inserted into the poke-in terminal portion.

Figure 11:
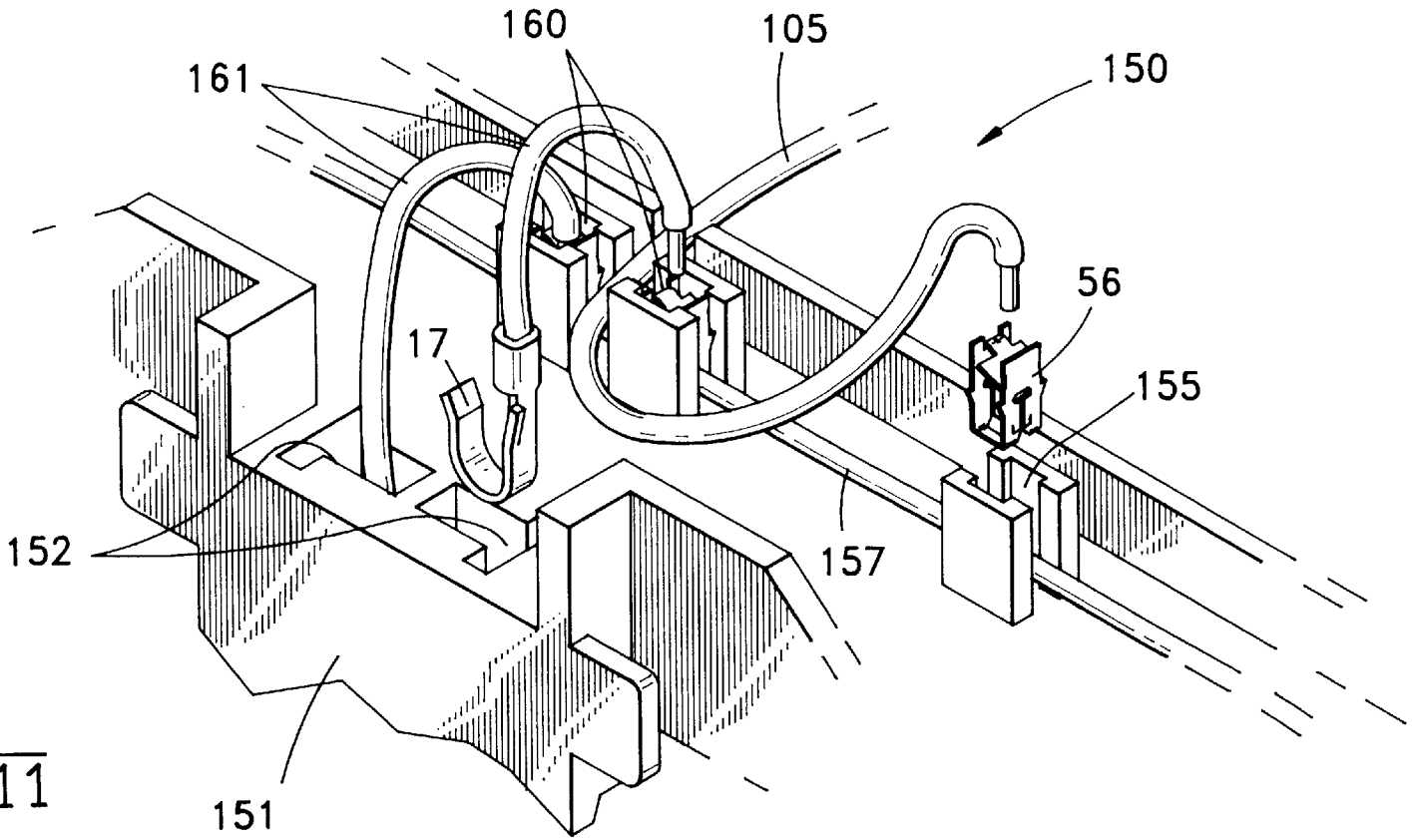
FIG. 11 is a view showing the manner in which fluorescent lamp terminals are attached to a bus wire in the embodiment of FIGS. 9 and 10.

The poke-in terminal portion of each splicing terminal 56 is accessible through the open end of its corresponding pocket 160. As shown in FIG. 11, fluorescent lamp terminals 17 located in the cavities 152 are each connected to the common bus wire 157 by a respective lead wire 161. The stripped end of each lead wire 161 is inserted into the poke-in terminal portion of a corresponding splicing terminal 56 located in a pocket 160 adjacent to a corresponding lampholder cavity 152. All of the fluorescent lamp terminals 17 in the three-lamp lampholder connector 150 are thus electrically connected to the single bus wire 157. Therefore, all of the fluorescent lamp terminals 17 in the three-lamp lampholder connector 150 are electrically connected to each other.

The splicing terminal 56 in the seventh pocket 155, which is also connected to the single bus wire 157, is used to connect all of the fluorescent lamp terminals 17 in the three lampholders 151 to the ballast subassembly 104 located at the opposite end of the troffer in a three-lamp lighting assembly. A stripped end of wire 105 is inserted into the poke-in terminal portion of the splicing terminal 56 in the pocket 155, and in this manner the wire 105, extending the length of the lighting assembly, is connected to the bus wire 157 in the three-lamp lampholder connector 150. The opposite end of the wire 105 can be connected to the ballast in the ballast subassembly 104 by using a similar splicing terminal 56, not shown.

Each three-lamp lampholder connector 150 also includes slots 162 on opposite ends. These slots permit the bus wire 157 to extend beyond the ends of the lampholder connector 150. These slots 162 are aligned with the bus wire 157 and facilitate efficient assembly of the three-lamp lampholder connector 150. A series of three-lamp lampholder connector housings can be positioned end to end with slots 162 in alignment. A continuous wire can then be laced through troughs on the bottoms of the housings with the continuous wire extending through the slots 162. A portion of the wire extending between each pair of adjacent housings can be cut, thereby severing the wire connection between the adjacent housings. In this way, separate lampholder connectors can be wired in an efficient manner.

The three-lamp version of this lighting assembly shown in FIGS. 9–11 differs from the two or four-lamp version because all of the fluorescent lamp terminals 17 in the three-lamp version of the lampholder connector 150 are electrically connected. Therefore, two terminals 17 connected to two pins in the same fluorescent lamp are electrically commoned in the three lamp version. For the two-lamp lampholder connector 50 of FIGS. 7 and 8, the terminals 17 which are connected to the same lamp are not electrically commoned. Instead, each fluorescent lamp terminal 17 in one lampholder 51 of the lampholder connector 50 is connected to corresponding terminals 17 having the same relative position in the other lampholder 51. In other words, terminals on the right side of each lampholder are electrically connected together and terminals on the left side of each lampholder are electrically connected together, but right-side terminals are not electrically connected to left-side terminals. It should be understood, however, that all of the terminals 17 for the two-lamp version 50 could be connected to a single bus in the same manner as for the three-lamp lampholder connector 150 because the ballast need not be connected directly to an individual pin on lamps connected to the lampholder connectors.

The use of integrally molded lampholders 51 simplifies the assembly of the lampholder connectors 50 which are assembled in much the same manner as the lampholder connectors 150. Terminals 17 previously connected to wires can be inserted into lampholder terminal cavities on the lower surface 53 in the same manner as for the ballast lampholder cover 8. The use of splicing terminals with the three-lamp lampholder connector 150 has been previously discussed.

Although the use of integrally molded lampholders greatly simplifies assembly of both the ballast lampholder subassemblies and the lampholder connectors, it should be understood that some, though not all, of this improvement can be achieved by attaching separately molded lampholders to a molded cover or to the lampholder connector base. Although this variation adds an assembly step, it still uses the same basic approach to achieve the other advantages of this invention. This is but one of the minor changes that can be resorted to without departing from the scope of the invention defined by the following claims.

We claim:

1. A lighting assembly for use in mounting a plurality of fluorescent lamps comprising:

a ballast lampholder subassembly located at a first end of the lighting assembly, including a ballast lampholder housing with ballast circuitry mounted within the ballast lampholder housing connected to terminals in lampholders extending from the housing;

at least one lampholder connector mounted on a second end of the lighting assembly, the lampholder connector including spaced-apart lampholders extending from a lampholder connector base with lampholder terminals in at least two of the lampholders being connected by lead wires extending through the lampholder connector base;

wherein the lampholders of the ballast lampholder subassembly and the lampholder connector comprise integrally molded extensions of the ballast lampholder housing and the lampholder connector base, respectively.

2. The lighting assembly of claim 1 wherein the ballast lampholder housing comprises a molded cover attached to a ballast lampholder base, and the lampholders of the ballast lampholder housing comprise molded extensions of the molded cover.

3. The lighting assembly of claim 2 wherein the lampholders of the ballast lampholder housing include terminal cavities which open to an interior of the housing so that the terminals can be inserted into the lampholders through the openings.

4. The lighting assembly of claim 2 wherein the ballast lampholder base comprises a metal plate attached to the ballast lampholder housing cover.

5. The lighting assembly of claim 4 wherein the ballast circuitry is mounted on a circuit board positioned on the ballast lampholder base.

6. The lighting assembly of claim 5 further comprising lead wires electrically connecting the terminals to the circuit board.

7. The lighting assembly of claim 2 wherein the molded cover includes protruding sections separated by channels, and the lampholders are located in the channels.

8. The lighting assembly of claim 1 wherein the lampholders of the lampholder connector include terminal cavities which are open to a lower surface of the lampholder connector base, the terminals are disposed in the cavities, and the terminals are connected by lead wires which extend along the lower surface of the lampholder connector base.

9. The lighting assembly of claim 1 wherein the ballast lampholder subassembly and the lampholder connector are mounted at opposite ends of a fluorescent lighting troffer.

10. The lighting assembly of claim 9 wherein the ballast lampholder subassembly and the lampholder connector are separate with each attached only to the fluorescent lighting troffer and to fluorescent lamps extending therebetween.

11. A ballast lampholder subassembly for use in a fluorescent lighting fixture comprising:

a molded ballast lampholder cover with lampholders extending from the ballast lampholder cover, each of the lampholders including a pair of terminal cavities opening to an interior surface of the ballast lampholder cover;

fluorescent lamp terminals insertable into the terminal cavities after first ends of wire leads have been terminated to the fluorescent lamp terminals;

a circuit board with ballast circuitry and ballast components mounted on the circuit board, second ends of the wire leads being attached to the circuit board; and a ballast lampholder base attached to the ballast lampholder cover to form a ballast lampholder housing, the circuit board and the wire leads which connect the fluorescent lamp terminals to the ballast circuitry and to the ballast components being positioned within the ballast lampholder housing.

12. The ballast lampholder subassembly of claim 11 wherein the lampholders comprise molded extensions of the molded ballast lampholder cover.

13. The ballast lampholder subassembly of claim 12 wherein the molded ballast lampholder cover encloses three sides of the ballast lampholder housing and the ballast lampholder base encloses a fourth side of the ballast lampholder housing.

14. The ballast lampholder subassembly of claim 13 wherein the ballast lampholder base comprises a metal plate.

15. The ballast lampholder subassembly of claim 14 wherein the ballast lampholder cover is snapped to the metal plate.

16. The ballast lampholder subassembly of claim 14 wherein the circuit board is mounted on an interior surface of the ballast lampholder base.

17. The ballast lampholder subassembly of claim 13 wherein the molded ballast lampholder cover includes multiple enclosure sections separated by channels having a smaller volume than the enclosure sections, the molded lampholders extending from the channels with the enclosure sections providing space for housing ballast components.

18. The ballast lampholder subassembly of claim 17 wherein the lampholders are equally spaced-apart between opposite ends of the ballast lampholder housing.

19. The ballast lampholder subassembly of claim 17 wherein the ballast lampholder cover includes a mounting pocket for supporting a splicing terminal for connecting power leads to the printed circuit board.

20. A method of assembling a ballast subassembly for use in a lighting fixture comprising the steps of:

terminating insulated wire leads to terminals;

inserting the terminals into lampholders molded as part of a ballast lampholder housing cover with the insulated wire leads extending from the terminals;

connecting opposite ends of the wire leads to a circuit board containing ballast circuitry and ballast components;

positioning the circuit board between a ballast lampholder housing base and the ballast lampholder housing cover; and attaching the ballast lampholder housing base to the ballast lampholder housing cover to form a ballast lampholder housing which encloses the circuit board and the wire leads.

* * * * *